US007521642B2

(12) United States Patent
Belanger

(10) Patent No.: US 7,521,642 B2
(45) Date of Patent: Apr. 21, 2009

(54) SWITCH ASSEMBLY FOR AN AUTOMOTIVE POWER WINDOW

(75) Inventor: James Lee Belanger, Canton, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 306 days.

(21) Appl. No.: 11/348,167

(22) Filed: Feb. 6, 2006

(65) Prior Publication Data

US 2007/0181414 A1 Aug. 9, 2007

(51) Int. Cl.
*H01H 9/06* (2006.01)

(52) U.S. Cl. ..... 200/339; 200/332.2

(58) Field of Classification Search ..... 200/341–345, 200/332.2, 520, 61.47, 537; 400/490, 495, 400/279

See application file for complete search history.

(56) References Cited

U.S. PATENT DOCUMENTS

| | | | | |
|---|---|---|---|---|
| 1,656,952 | A | 1/1928 | Nutt | |
| 2,824,915 | A | 2/1958 | Buturuga | |
| 3,732,388 | A * | 5/1973 | Taylor | 200/303 |
| 3,786,968 | A | 1/1974 | Ewald | 22/402.11 |
| 4,168,416 | A * | 9/1979 | Josemans | 200/43.04 |
| 4,221,941 | A * | 9/1980 | Genovese | 200/457 |
| 4,920,238 | A * | 4/1990 | Aso | 200/6 R |
| 4,943,695 | A | 7/1990 | Valis | 200/345 |
| 5,150,913 | A | 9/1992 | Hoelzl | 280/612 |
| 5,720,285 | A * | 2/1998 | Petersen | 600/459 |
| 5,833,048 | A * | 11/1998 | Dilly | 200/446 |
| 6,054,655 | A * | 4/2000 | Rudolph et al. | 200/16 R |
| 6,087,605 | A | 7/2000 | Heidenfels et al. | 200/345 |
| 6,255,610 | B1 * | 7/2001 | Botz et al. | 200/315 |
| 6,737,596 | B1 * | 5/2004 | Hein | 200/310 |
| 6,914,205 | B2 | 7/2005 | Galea | 200/43.01 |

FOREIGN PATENT DOCUMENTS

| | | |
|---|---|---|
| DE | 4221941 A1 * | 1/1994 |
| JP | 06060772 | 3/1994 |
| JP | 06139869 | 5/1994 |

* cited by examiner

*Primary Examiner*—Michael A Friedhofer
*Assistant Examiner*—Lisa N Klaus
(74) *Attorney, Agent, or Firm*—Gifford, Krass, Sprinkle, Anderson & Citkowski, P.C.

(57) ABSTRACT

A switch assembly for an automotive power window having a housing and an actuator with two spaced-apart ends pivotally mounted to the housing about a transverse axis extending across a central portion of the actuator. The actuator includes a first actuator surface extending between the axis on one end of the actuator and a second actuator surface extending between the axis and the other end of the actuator. The actuator is pivotal in a first direction from a rest position by depression of the first actuator surface and is pivotal in the opposite direction from the rest position and to a second position upon depression of the second actuator surface. The second actuator surface is recessed within the housing in an amount sufficient to prevent actuation of the actuator to its second position by a sphere having a radius greater than or equal to 19 millimeters which approximates the size of a child's knee.

17 Claims, 2 Drawing Sheets

SWITCH ASSEMBLY FOR AN AUTOMOTIVE POWER WINDOW

BACKGROUND OF THE INVENTION

I. Field of the Invention

The present invention relates generally to electrical switches and, more particularly, to an electrical rocker switch of the type utilized to control the actuation of automotive power windows.

II. Description of Related Art

There are several different types of switches utilized to control the actuation of power windows in an automotive vehicle. One type of such switch is known as a rocker switch.

The previously known rocker switches typically comprise a housing having an actuator pivotally mounted about a midpoint to the housing thus defining a first actuator surface from the pivot axis to one end of the actuator and a second actuator surface from the pivot axis to the other end of the actuator. A spring maintains the actuator at a rest position relative to the housing. In order to actuate the power window in a down direction, the first actuator surface is depressed which pivots the actuator in a first direction thus completing the electrical contact necessary to actuate the window in a down direction. Conversely, depression of the second actuator surface pivots the actuator from the rest position in the opposite direction and to a second position thus completing the electrical contacts necessary to actuate the window in an up direction.

One disadvantage of these previously known rocker switches for power automotive windows is that the switch may be unintentionally actuated in the up direction, e.g. by the knee of a child. This, in turn, can result in injury if the child's head or arm is protruding out from the window.

SUMMARY OF THE PRESENT INVENTION

The present invention provides an automotive switch assembly for an automotive power window which overcomes all of the above-mentioned disadvantages of the previously known devices.

In brief, the switch assembly of the present invention comprises a housing and an actuator having two ends which is pivotally mounted to the housing about a transverse axis extending across a central portion between the ends of the actuator. The actuator thus has a first actuator surface extending from the axis to one end of the actuator and a second actuator surface extending from the axis to the other end of the actuator.

The actuator is pivotal in a first direction from the rest position to a first position upon depression of the first actuator surface to complete the electrical contacts necessary to actuate the window in a down direction. Similarly, depression of the second actuator surface pivots the actuator from its rest position in the opposite pivotal direction to a second position to complete the electrical contacts to actuate the power window to an up or closed direction.

In order to prevent unintended actuation of the switch to move the window in an upward direction, the second actuator surface is recessed within the housing by an amount sufficient to prevent actuation of the actuator to its second position by a sphere having a radius greater than or equal to 20±1 millimeters. Such a sphere approximates the size of a child's knee according to U.S. government regulation FMVSS 118.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
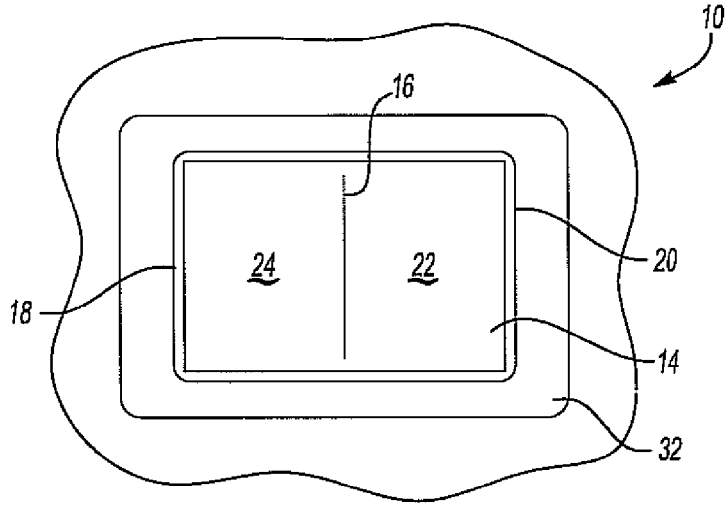
FIG. 1 is a plan view illustrating a preferred embodiment of the switch assembly of the present invention.
Figure 2:
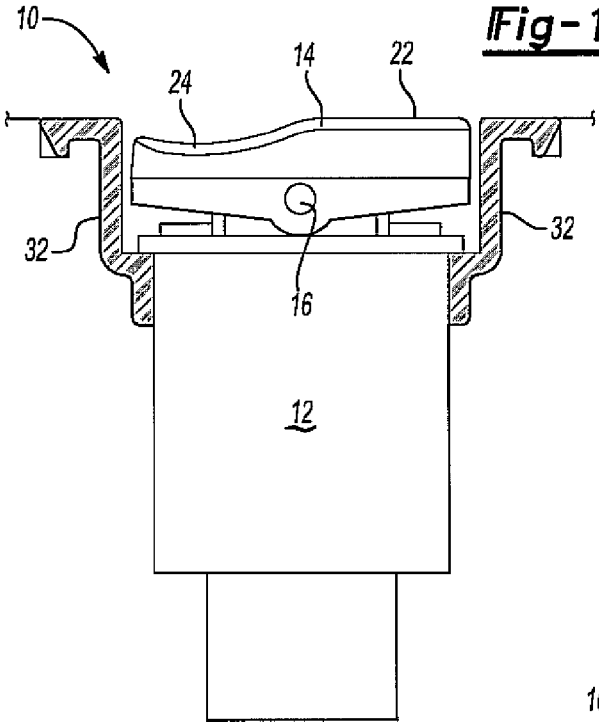
FIG. 2 is a side view thereof.

With reference first to FIGS. 1 and 2, a preferred embodiment of the switch assembly 10 of the present invention is shown. The switch assembly 10 is of the type used to control the actuation of power windows in an automotive vehicle.

Figure 3:
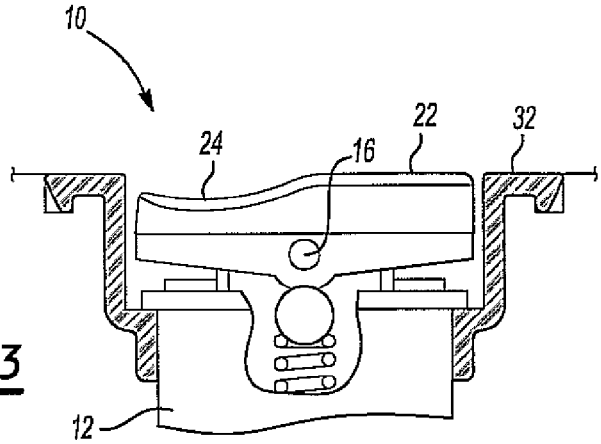
FIG. 3 is a cross-sectional view of the switch assembly.
Figure 4:
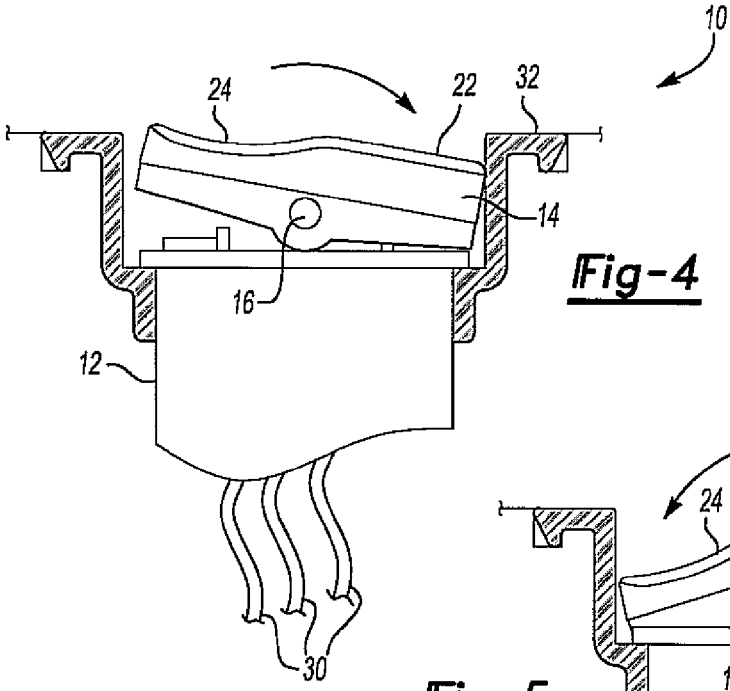
FIGS. 4 and 5 are side views illustrating the different actuation of the switch assembly.

Referring now to FIGS. 1-3, the switch assembly 10 includes a housing 12 and an actuator 14 which is pivotally mounted to the housing 12 in any conventional fashion about an axis 16. Furthermore, as best shown in FIG. 1, the axis 16 extends transversely across a central portion of the actuator 14 and is preferably positioned midway between two ends 18 and 20 of the actuator 14. The pivotal axis 16 thus defines a first actuator surface 22 which extends between the axis 16 and the actuator end 18, and a second actuator surface 24 which extends from the axis 16 to the other actuator end 20.

With reference now particularly to FIGS. 2-5, conventional means, such as a spring-loaded ball, are contained within the housing 12 and resiliently bias the actuator 14 to a rest position illustrated in FIGS. 2 and 3. However, depression of the first actuator surface 22 causes the actuator 14 to pivot about the axis 16 to a first position illustrated in FIG. 4. In doing so, conventional electrical contacts within the switch assembly housing 12 provide the necessary connections via electric terminals 30 to actuate the window motor to move the window in a down direction. Conversely, depression of the other actuating surface 24 causes the actuator 14 to pivot in the opposite direction to a second position, illustrated in FIG. 5, which provides the necessary output signals from the terminals 30 to actuate the window motor in an up direction.

The electrical circuitry within the housing 12 may be of any conventional construction and typically comprises a single throw, double pole electrical switch. Similarly, any conventional means may be utilized within the housing 12 to maintain the switch actuator 14 biased in its rest position.

Figure 6:
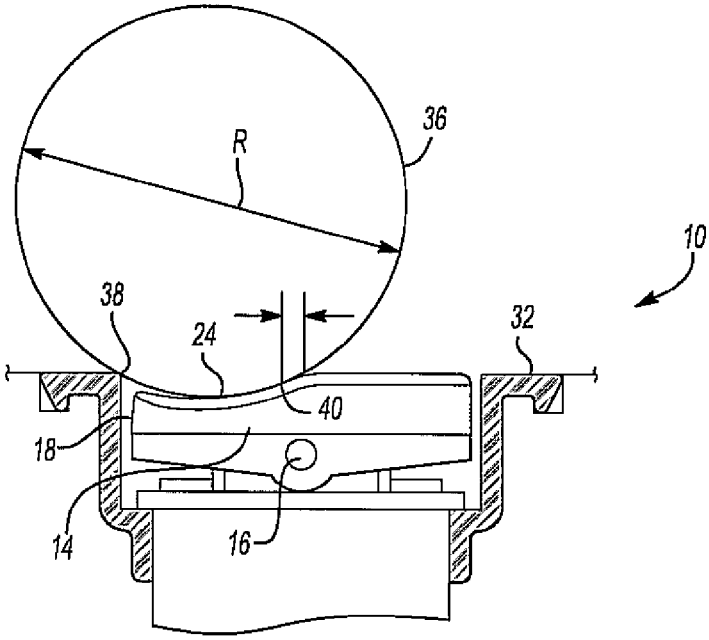
FIG. 6 is a view similar to FIG. 3 and illustrating the operation of the present invention.

With reference now particularly to FIGS. 2 and 6, the housing 12 includes a bezel 32 which surrounds the actuator 14. The bezel 32 may be either integrally formed with the housing 12 or of a two-part construction with the housing 12.

Figure 5:
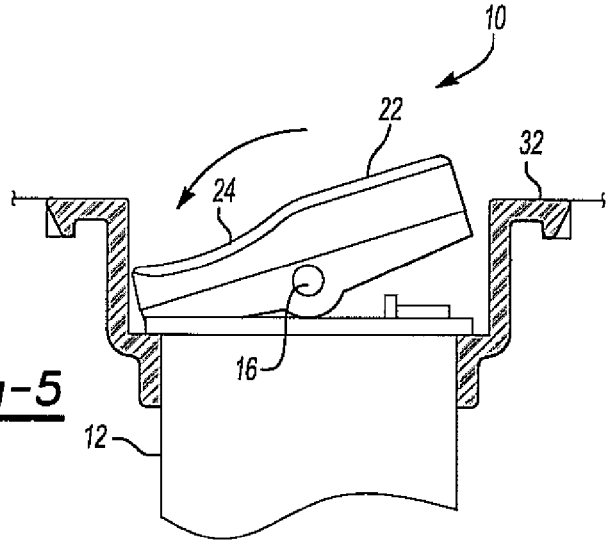

As best shown in FIG. 6, the actuator surface 24 is generally concave in shape and is recessed below the housing bezel 32 from a transverse line 40 positioned closely adjacent the axis 16 and to the end 18 of the actuator 14. Furthermore, the actuator surface 24 is recessed by an amount sufficient such that a sphere 36 having a radius R of 15 millimeters or more and preferably 19 millimeters or more when applied against the second actuator surface 24 contacts the housing bezel 32 at point 38 and simultaneously contacts the actuator surface 24 at point 40 which is closely adjacent the pivotal axis 16 for the actuator 14. A sphere having a radius of 20±1 millimeters, i.e. greater than or equal to 19 millimeters, approximates the size of a knee of a child per U.S. government regulations. Consequently, the interference between the sphere 36 and the housing bezel 38 stops the sphere 36 when applied with a force of less than or equal to 135 newtons from contacting the second actuator surface 24 with sufficient pressure to cause the actuator to move to the second position as illustrated in FIG. 5 thus preventing window actuation in the up direction. Government regulations define 135 newtons as the force that can be applied by a child's knee.

From the foregoing, it can be seen that the present invention provides a simple yet highly effective switch assembly particularly useful for automotive power windows which effectively prevents the unintentional activation of the power window toward the up or closed position by relatively large objects, e.g. objects corresponding in size to the size of a child's knee.

Having described my invention, however, many modifications thereto will become apparent to those skilled in the art to which it pertains without deviation from the spirit of the invention as defined by the scope of the appended claims.

I claim:

1. A switch assembly for an automotive power window comprising:

a housing, an actuator having spaced-apart ends, said actuator being pivotally mounted to said housing about a transverse axis extending across an intermediate position between the ends of the actuator, said actuator having a first actuator surface extending from said axis to one end of said actuator and a second actuator surface extending from said axis to the other end of said actuator, said actuator being pivotal in a first direction from a rest position to a first position upon depression of said first actuator surface and pivotal in an opposite direction from said rest position to a second position upon depression of said second actuator surface, wherein of said first and second actuator surfaces, only said second actuator surface is recessed within said housing in an amount sufficient to prevent actuation of said actuator to said second position by a sphere having a radius greater than 15 millimeters when applied with less than a predefined force.

2. The invention as defined in claim 1 wherein said second actuator surface is recessed within said housing in an amount sufficient to prevent actuation of said actuator to said second position by a sphere having a radius greater than or equal to 19 millimeters when applied with less than said predefined force.

3. The invention as defined in claim 2 wherein the predefined force is less than or equal to 135 newtons.

4. The invention as defined in claim 1 wherein said housing includes a bezel extending around said actuator and wherein said second actuator surface is recessed within said bezel.

5. The invention as defined in claim 1 and comprising means for resiliently biasing said actuator in said rest position.

6. The invention as defined in claim 1 wherein said actuator surfaces are rectangular in shape.

7. The invention as defined in claim 6 wherein said first and second actuator surfaces are substantially the same size.

8. The invention as defined in claim 1 wherein said axis is positioned midway between said ends of said actuator.

9. The invention as defined in claim 1 wherein said second actuator surface is concave in shape.

10. A switch assembly for an automotive power window comprising:

a housing, an actuator having spaced-apart ends, said actuator being pivotally mounted to said housing about a transverse axis extending across an intermediate position between the ends of the actuator, said actuator having a first actuator surface extending from said axis to one end of said actuator and a second actuator surface extending from said axis to the other end of said actuator, said actuator being pivotal in a first direction from a rest position to a first position upon depression of said first actuator surface and pivotal in an opposite direction from said rest position to a second position upon depression of said second actuator surface, wherein of said first and second actuator surfaces, only said second actuator surface is recessed within said housing in an amount sufficient to prevent actuation of said actuator to said second position by a child's knee at less than a predefined force.

11. The invention as defined in claim 10 wherein said predefined force is 135 newtons.

12. The invention as defined in claim 10 wherein said housing includes a bezel extending around said actuator and wherein said second actuator surface is recessed within said bezel.

13. The invention as defined in claim 10 and comprising means for resiliently biasing said actuator in said rest position.

14. The invention as defined in claim 10 wherein said actuator surfaces are rectangular in shape.

15. The invention as defined in claim 14 wherein said first and second actuator surfaces are substantially the same size.

16. The invention as defined in claim 10 wherein said axis is positioned midway between said ends of said actuator.

17. The invention as defined in claim 10 wherein said second actuator surface is concave in shape.

* * * * *